US005342063A

United States Patent [19]

O'Brien et al.

[11] Patent Number: 5,342,063

[45] Date of Patent: Aug. 30, 1994

[54] APPARATUS FOR A BALL GAME

[76] Inventors: Brendan J. O'Brien, 89 Ronald Avenue, Linbro Park, Sandton, Transvaal, South Africa; Michael A. Ross, P.O. Box 370, York Beach, Me. 03909

[21] Appl. No.: 59,334

[22] Filed: May 11, 1993

[30] Foreign Application Priority Data

May 12, 1992 [ZA] South Africa ..... 92/3402

[51] Int. Cl.[5] ..... A63B 63/00

[52] U.S. Cl. ..... 273/396; 273/26 A; 273/29 A; 273/182 R

[58] Field of Search ..... 273/396, 394, 26 A, 273/29 A, 182 R, 181 F, 181 K

[56] References Cited

U.S. PATENT DOCUMENTS 2,059,365 11/1936 King ..... 273/26 A
2,264,127 11/1941 Arge ..... 273/381
4,334,681 6/1982 Scheie ..... 273/30
4,421,318 12/1983 Sverdlik et al. ..... 273/395

FOREIGN PATENT DOCUMENTS 45346 2/1982 European Pat. Off. ..... 273/29 A
87/7264 5/1988 South Africa .
642980 9/1950 United Kingdom ..... 273/29 A

*Primary Examiner*—William H. Grieb

[57] ABSTRACT

Apparatus for a ball game which includes a plurality of rigid sections which interengage with one another to form a member of rectangular outline which has an arcuate ball returning surface, a plurality of rods each of which is engaged with, and projects outwardly from, a respective section, and sheet material which is engaged under tension with outer ends of the respective rods to assist in maintaining the sections interengaged.

5 Claims, 2 Drawing Sheets

36
38
52
54
62
56
64
58
60
66
68
42
24
28
30
46
40
44
50
32
22
48
26

APPARATUS FOR A BALL GAME

BACKGROUND OF THE INVENTION

This invention is concerned with apparatus for a ball game.

SUMMARY OF THE INVENTION

The invention provides apparatus for a ball game which includes a plurality of rigid sections which interengage with one another to form a member of rectangular outline which has an arcuate ball returning surface, a plurality of rods each of which is engaged with, and projects outwardly from, a respective section, and sheet material which is engaged under tension with outer ends of the respective rods to assist in maintaining the sections interengaged.

The sheet material may be continuous sheet material or it may be apertured but preferably comprises a net or mesh material.

The sections are preferably identical. Each section may be of rectangular outline with a first pair of opposed sides which have complementary fixing formations and a second pair of opposed sides which comprise an outer side, and an inner side with securing formations.

The complementary fixing formations may include at least one recessed formation on one of the respective sides and at least one complementary protruding formation on the other respective side.

The securing formations on the said inner side may comprise at least one recessed formation and at least one complementary protruding formation.

Each section may have at least two sockets which are located respectively to one side of each corner formed by the said outer side and the said pair of opposed sides, and each socket is engageable with an end of one of the said plurality of rods.

The invention also extends to a section for use in a ball game apparatus, the section being made from a plastics material of rectangular outline and including:

- a front surface which at least partly forms an arcuate ball returning surface,
- a rear surface,
- first and second opposed sides,
- the first opposed side having at least one recessed formation,
- the second opposed side having at least one complementary protruding formation,
- third and fourth opposed sides,
- the third opposed side comprising an outer side,
- the fourth opposed side comprising an inner side and having at least one recessed formation, at least one complementary protruding formation and two semi-sockets, and
- the rear surface having reinforcing formations and two sockets which are located respectively to one side of each corner formed by the said outer side and the said first and second opposed sides.

BRIEF DESCRIPTION OF THE DRAWINGS

The invention is further described by way of example with reference to the accompanying drawings in which.

DESCRIPTION OF PREFERRED EMBODIMENT

Figure 2:
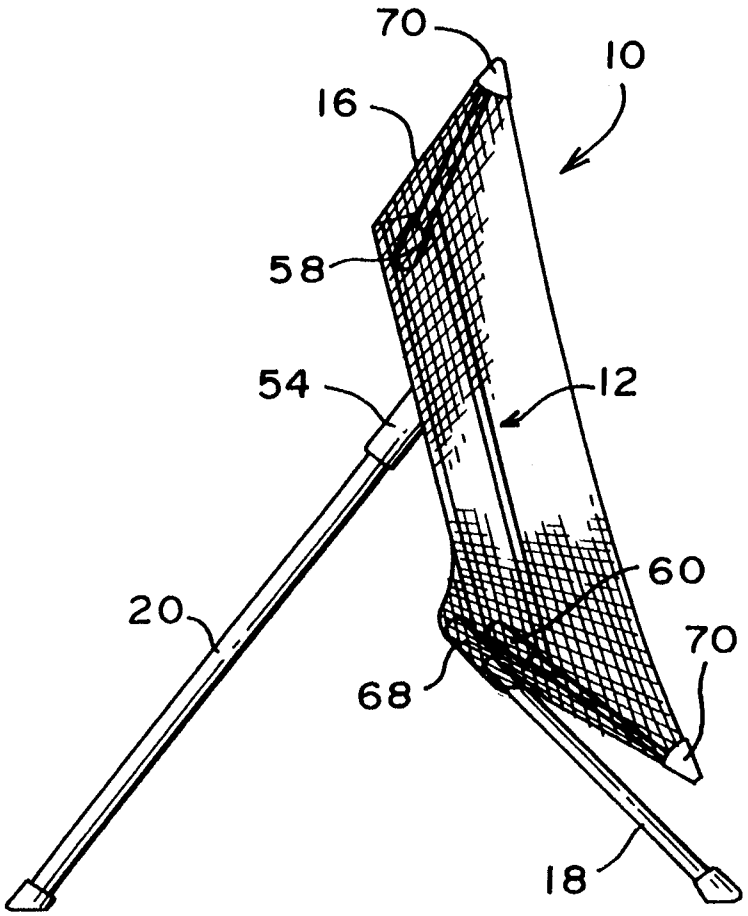
FIG. 2 is a side view of the apparatus of FIG. 1.
Figure 1:
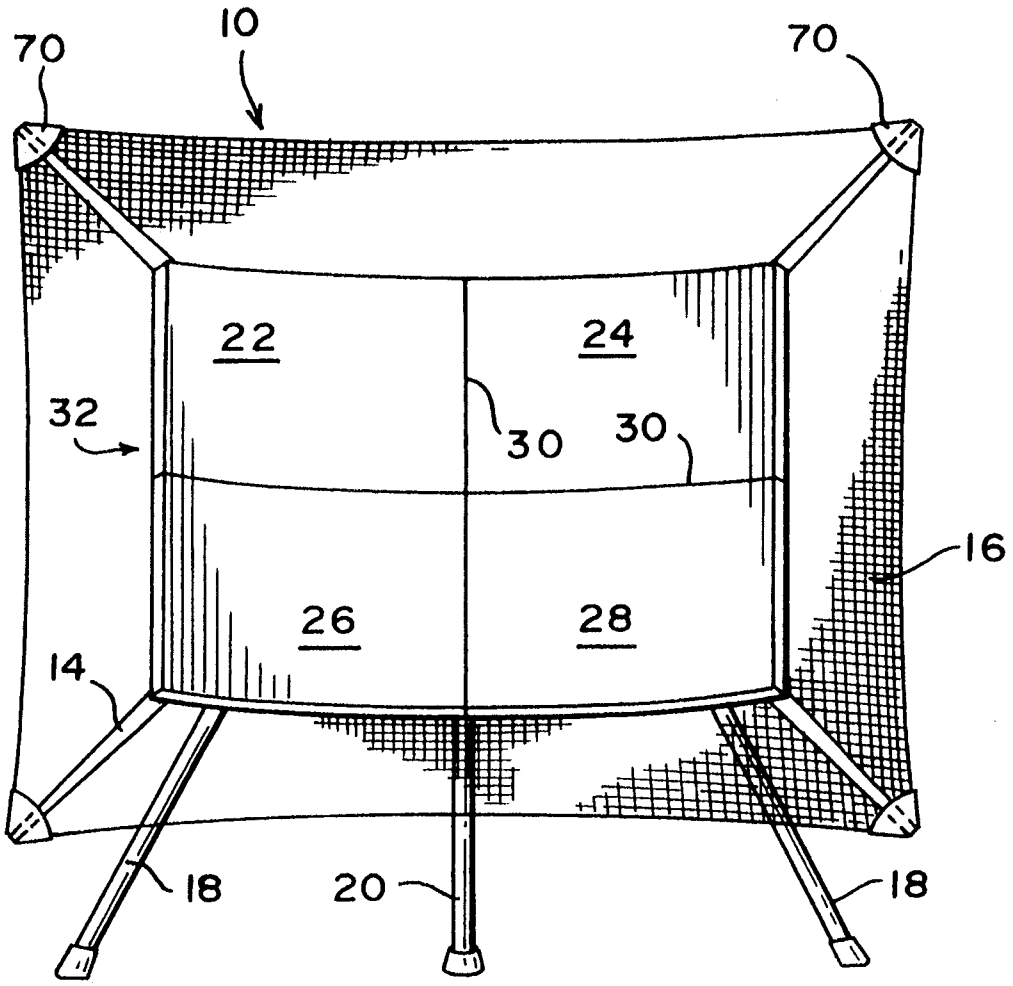
FIG. 1 is a front view of a ball game apparatus according to the invention.

FIGS. 1 and 2 of the accompanying drawings illustrate a ball game apparatus 10 according to the invention which includes a ball returning member 12, four rods 14 at respective corners of the member 12, a net 16 which is engaged with the rods, and support legs for the member designated 18 and 20 respectively. The member 12 is rectangular in outline and is made from four identical sections 22, 24, 26 and 28 respectively. The section 24 is shown in FIGS. 3, 4 and 5 although, as stated, it is to be understood that the sections are identical.

Figures 3, 4, 5:
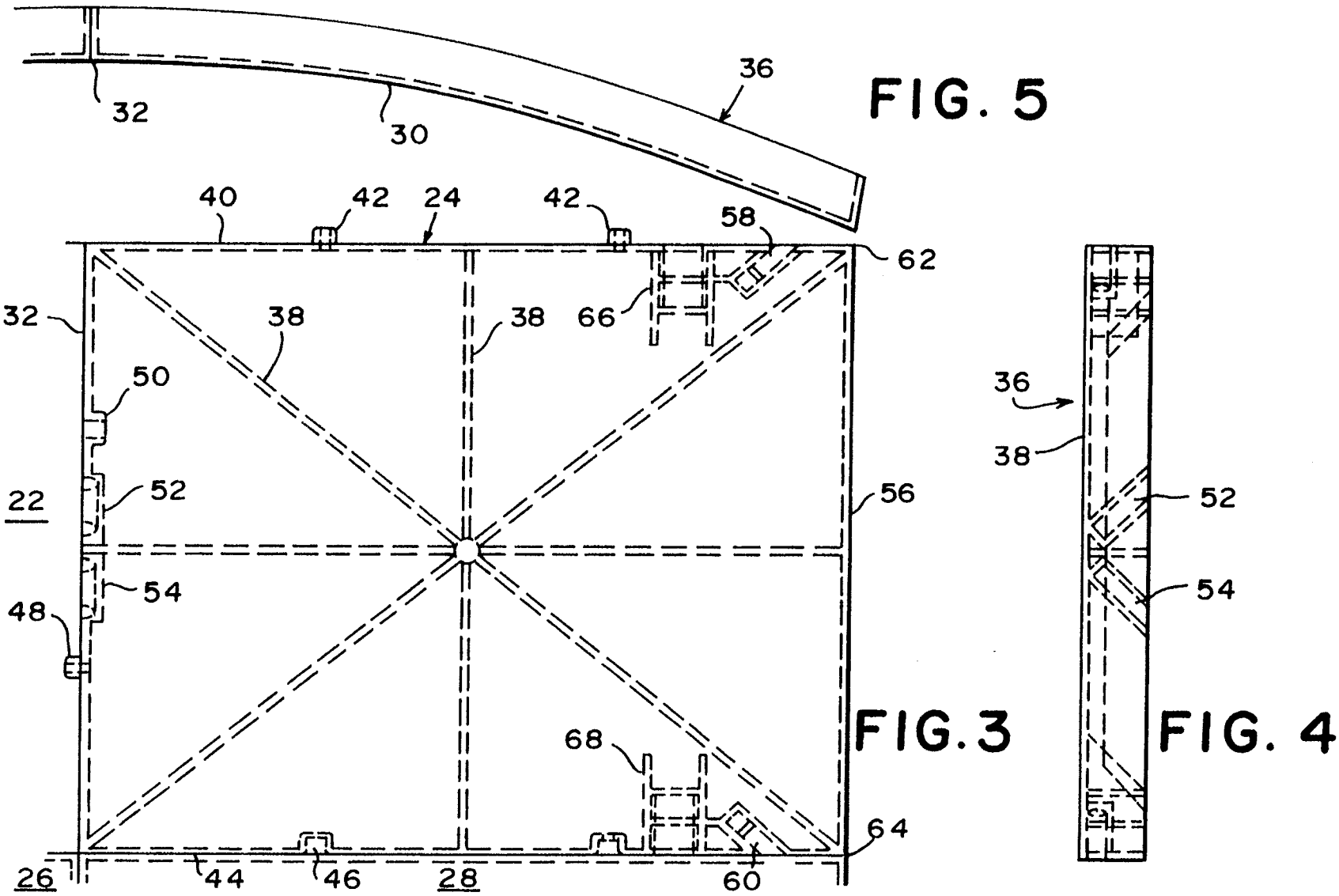
FIG. 3 is a front view, on an enlarged scale, of one section used in the apparatus of FIG. 1.
FIG. 4 is a side view of the section shown in FIG. 3.
FIG. 5 is a plan view of the section of FIG. 3.

FIGS. 3, 4 and 5 illustrate the section 24 from the front, from the side and in plan respectively. The section is moulded from a suitable plastics material and has a rectangular outline. The section includes a front surface 30 which is curved about an inner side 32 of the section. This is evident particularly from FIG. 5.

The section has a rear surface 36 which carries reinforcing ribs 38. On one side 40 the section has two protrusions 42 while on an opposing side 44 the section has complementary recessed formations 46.

The inner side 32 has one protrusion 48 and a recessed formation 50 which is complementary to the protrusion 48. Two semi-sockets 52 and 54, which are trough-like, are positioned on the inner side 32.

The section has an outer side 56, which opposes the inner side 32, which has no formations.

Angled sockets 58 and 60 are respectively located near corners 62 and 64 which are formed by the outer side 56 and the sides 40 and 44 respectively. Vertically aligned relatively large sockets 66 and 68 are located adjacent the sockets 58 and 60 respectively.

It is apparent from an examination of FIG. 3 that due to the nature, shape and locations of the protrusions 42 and 48 and the complementary recessed formations 46 and 50 respectively that the four sections 22 to 28 can be interengaged to form the relatively large rectangular member 12 of FIG. 1. The semi-sockets 52 and 54 mate with similar semi-sockets on the section 22 to form full sockets. One of these sockets is engaged with the upper end of the support leg 20 of FIG. 1. Similarly the lower sockets 68 on the sections 26 and 28 are respectively engaged with upper ends of the support legs 18 of FIG. 1.

The rods 14 are respectively inserted into the angled sockets 58 or 60 at the four corners of the rectangular member 12.

The various formations 42, 46, 48 and 50 serve two functions. In the first instance they ensure that the sections correctly and precisely align with one another in such a way that at their adjacent surfaces the sections present a smooth outer surface which is the surface which is visible in FIG. 1. Secondly the formations assist in maintaining the various sections interengaged with one another. For this purpose the various formations interengage with a relatively tight friction fit.

The net 16 however also has a dual purpose. On the one hand the net is provided to intercept a ball which may be aimed at the front surface of the member 12 but which does not strike the surface. Provided the ball is not too far off the mark it is intercepted by the net and retrieval of the ball for further play is thereby facilitated. On the other hand the net 16 is slightly elastic. The net is provided with four pockets 70 at its respective four corners and each pocket is engaged with an outer end of one of the rods 14. The net is rectangular and extends over the rear surface 36 of the four sections. When the four pockets are engaged with the rods the net is tensioned and a resulting inwardly directed force is thereby produced which is constantly maintained and which urges the four sections 22 to 28 towards one another ensuring that the sections remain interengaged.

Any suitable ball game can be played on the apparatus 10. Thus using racquets or bats one or more players can aim a ball at the member 12 and continue playing until such time as the ball is not correctly returned by the member. This gives rise to a system of points scoring. The nature of the game which is played on the apparatus is not important to an understanding of the present invention.

The member 12 has fairly substantial dimensions. If the member were to be fabricated with a unitary construction then transport and storage thereof could be cumbersome and difficult. By fabricating the member 12 from four identical sections the manufacturing cost is substantially reduced and transport and storage aspects are considerably facilitated. As has been indicated the net 16 assists in maintaining the sections 22 to 28 interengaged with one another. This is a preferred feature of the invention for no additional attachment means are required to keep the sections 22 to 28 in their correct relationship to one another.

The various sections 22 to 28 are relatively lightweight for their outer or playing surfaces 30, which are relatively accurately formed, are supported on the rear surface 36 by means of the reinforcing ribs 38.

It is apparent that an excess number of the sockets 58 and 60 and 66 and 68, and of the semi-sockets 52 and 54, are provided in the four sections. It is however this redundancy which enables the four sections to be made identical to one another.

We claim:

1. Apparatus for a ball game which includes a plurality of rigid sections which interengage with one another to form a member of rectangular outline which has an arcuate ball returning surface, a plurality of rods each of which is engaged with, and projects outwardly from, a respective section, and sheet material which is engaged under tension with outer ends of the respective rods to assist in maintaining the sections interengaged; the sections being identical and each section being of rectangular outline with a first pair of opposed sides which have complementary fixing formations and a second pair of opposed sides which comprise an outer side, and an inner side with securing formations.

2. Apparatus according to claim 1 in which the complementary fixing formations include at least one recessed formation on one of the respective sides and at least one complementary protruding formation on the other respective side.

3. Apparatus according to claim 1 wherein the securing formations on the said inner side comprise at least one recessed formation and at least one complementary protruding formation.

4. Apparatus according to claim 1 in which each section has at least two sockets which are located respectively to one side of each corner formed by the said outer side and the said pair of opposed sides, and each socket is engageable with an end of one of the said plurality of rods.

5. A section for use in ball game apparatus, the section being made from a plastics material of rectangular outline and including:

a front surface which at least partly forms an arcuate ball returning surface, a rear surface, first and second opposed sides, the first opposed side having at least one recessed formation, the second opposed side having at least one complementary protruding formation, third and fourth opposed sides, the third opposed side comprising an outer side, the fourth opposed side comprising an inner side and having at least one recessed formation, at least one complementary protruding formation and two semi-sockets, and the rear surface having reinforcing formations and two sockets which are located respectively to one side of each corner formed by the said outer side and the said first and second opposed sides.

* * * * *